United States Patent [19]

Bhalla

[11] 4,321,503

[45] Mar. 23, 1982

[54] HID LAMP ELECTRODE COMPRISING BARIUM-CALCIUM NIOBATE OR TANTALATE

[75] Inventor: Ranbir S. Bhalla, Pine Brook, N.J.

[73] Assignee: Westinghouse Electric Corp., Pittsburgh, Pa.

[21] Appl. No.: 958,233

[22] Filed: Nov. 6, 1978

[51] Int. Cl.[3] ..... H01J 17/06; H01J 61/06

[52] U.S. Cl. ..... 313/211; 252/500

[58] Field of Search ..... 313/211, 346 R; 252/500; 423/593

[56] References Cited

U.S. PATENT DOCUMENTS

| | | | |
|---|---|---|---|
| 2,911,376 | 11/1959 | Rudolph | 313/346 R X |
| 3,266,861 | 8/1966 | Bleukens et al. | 316/16 |
| 3,434,812 | 3/1969 | Bondley | 313/346 R |
| 3,619,699 | 11/1971 | White | 313/211 |
| 3,708,710 | 1/1973 | Smyser et al. | 313/213 |
| 3,951,874 | 4/1976 | Kern | 423/593 X |
| 3,969,279 | 7/1976 | Kern | 313/346 R X |
| 4,052,634 | 10/1977 | Kok | 313/184 |

OTHER PUBLICATIONS

Galasso, "Structure, Properties and Preparation of Perovskite-Type Compounds"; Pergamon Press, New York.

*Primary Examiner*—Robert Segal
*Attorney, Agent, or Firm*—W. D. Palmer

[57] ABSTRACT

For HID lamps, and particularly high-pressure mercury or sodium-mercury HID lamps, the electron-emissive material portion of the lamp electrodes is $Ba_3CaM_2O_9$ wherein M is niobium, tantalum or any combinations thereof. The specified material is highly emissive, very refractory, and essentially completely non-reactive with respect to moisture.

8 Claims, 6 Drawing Figures

HID LAMP ELECTRODE COMPRISING BARIUM-CALCIUM NIOBATE OR TANTALATE

CROSS-REFERENCE TO RELATED APPLICATIONS

In copending application Ser. No. 844,154, filed Oct. 21, 1977, by Ranbir S. Bhalla, the present applicant, and owned by the present assignee, now U.S. Pat. No. 4,152,619, is disclosed an emissive material for HID lamp electrodes which comprises a solid solution of dibarium calcium tungstate and dibarium calcium molybdate, wherein the molar ratio of tungstate to molybdate is from 9:1 to 1:9.

In copending application Ser. No. 845,521, filed Oct. 26, 1977 by Ranbir S. Bhalla, the present applicant, and owned by the present assignee, now U.S. Pat. No. 4,152,619, is disclosed an emissive material for HID lamp electrodes which comprises $M_3M'_2M''O_9$ wherein M is alkaline-earth metal and at least principally comprises barium; M' is yttrium, a lanthanoid series metal, or any mixtures thereof; and M'' is tungsten, molybdenum, or mixtures thereof. This specified material is very stable and highly emissive.

BACKGROUND OF THE INVENTION

This invention relates to high-intensity-discharge (HID) lamps and, more particularly, to improved electron emissive material for the electrodes of such lamps.

In U.S. Pat. No. 3,708,710 dated Jan. 2, 1973 is disclosed a high-intensity-discharge sodium-mercury vapor lamp which utilizes dibarium calcium tungstate as electron emissive material. Such material has been used in so-called dispenser cathodes and U.S. Pat. No. 3,434,812 dated Mar. 25, 1969 discloses the use of dibarium calcium tungstate or dibarium strontium tungstate as an emissive material in a dispenser cathode.

Dibarium calcium molybdate is known for use as a getter layer material in conjunction with an incandescent lamp, as disclosed in U.S. Pat. No. 3,266,861, dated Aug. 16, 1966. In addition, high-pressure mercury-vapor lamps and sodium-mercury vapor lamps have in the past utilized as electron emissive material a mixture of several oxide phases comprising thorium dioxide, barium thorate, dibarium calcium tungstate and barium oxide. This mixture of oxide phases is quite sensitive to the atmospheric contaminants with the result that even a brief exposure to the air can result in a relatively large pickup of water and carbon dioxide by the emission mixture, which contaminants are rather difficult to remove. In such a mixture, the thorium dioxide serves as a matrix for the more active oxide emitters, such as barium oxide, dibarium calcium tungstate and barium thorate.

In U.S. Pat. No. 4,052,634 dated Oct. 4, 1977 to DeKok is disclosed an HID lamp having an electrode consisting of a support of a high-melting metal provided with an electron emissive material. The emissive material consists mainly of one or more oxide compounds containing (a) at least one of the rare earth metal oxides, (b) alkaline earth metal oxide in a quantity of 0.66 to 4 mole per mole of rare earth metal oxide and (c) at least one of the oxides of tungsten and molybdenum in a quantity of 0.25 to 0.40 mole per mole of alkaline earth metal oxide, with the alkaline earth metal oxide consisting of at least 25 mole % of barium oxide.

The compounds $Ba_3CaNb_2O_9$ and $Ba_3CaTa_2O_9$ are known as perovskite-type compounds, as disclosed in "Structure, Properties and Preparation of Perovskite-Type Compounds:" by Galasso, Pergamon Press (1969), see page 25 thereof.

SUMMARY OF THE INVENTION

There is provided in combination with an HID lamp comprising a radiation-transmitting arc tube having electrodes operatively supported therein proximate the ends thereof and adapted to have an elongated arc discharge maintained therebetween, together with means for connecting the electrodes to an energizing power source, the improved electrode structure for the lamp electrodes each of which comprises: an elongated refractory metal member having one end portion thereof supported proximate an end of the arc tube and the other end portion of the metal member projecting a short distance inwardly within the arc tube. An overfitting refractory metal coil means is carried on the inwardly projecting portion of the elongated metal member. In accordance with the present invention, electron emissive material is carried intermediate turns of the overfitting coil means and the electron emissive material consists essentially of $Ba_3CaM_2O_9$ wherein M is niobium, tantalum, or any combinations thereof, either in the form of mixtures or solid solutions. For some types of lamps, it is preferred to mix refractory metal powder with the specified emissive material with the powder constituting from 5% to 80% by weight of the electron emissive material.

BRIEF DESCRIPTION OF THE DRAWINGS

For a better understanding of the invention, reference may be had to the preferred embodiment, exemplary of the invention, shown in the accompanying drawings, in which.

DESCRIPTION OF THE PREFERRED EMBODIMENTS

Figure 1:
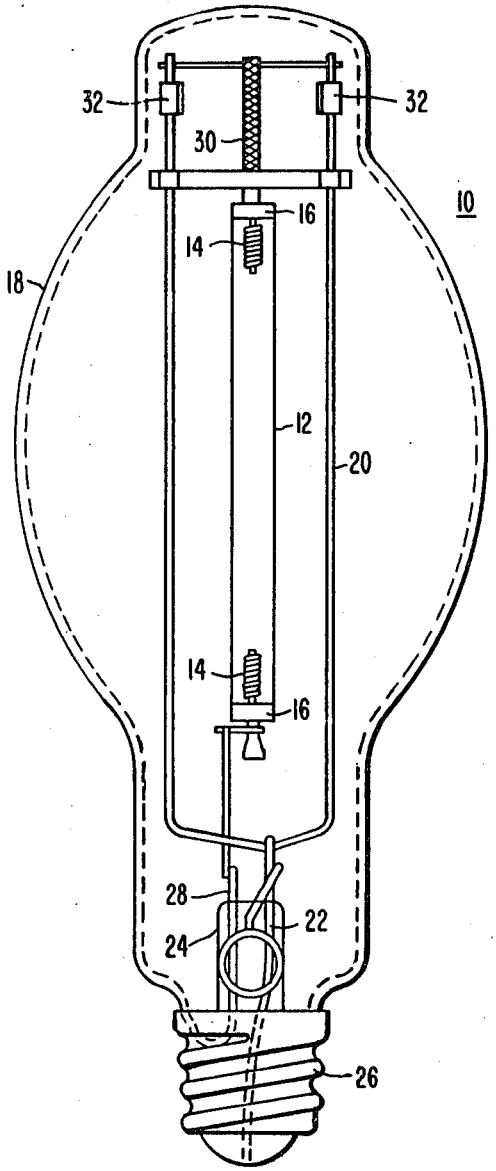
FIG. 1 is an elevational view of a typical HID sodium-mercury lamp which incorporates the present improved electrodes.

With specific reference to the form of the invention illustrated in the drawings, the lamp 10 is a typical HID sodium or sodium-mercury lamp comprising a radiation-transmitting arc tube 12 having electrodes 14 operatively supported therein proximate the ends thereof and adapted to have an elongated arc discharge maintained therebetween. The arc tube is fabricated of refractory material such as single crystal or polycrystalline alumina having niobium end caps 16 sealing off the ends thereof. The arc tube 12 is suitably supported within a protective outer envelope 18 by means of a supporting frame 20 which is connected to one lead-in conductor 22 sealed through a conventional stem press arrangement 24 for connection to the conventional lamp base 26. The other lead-in conductor 28 connects to the other lamp electrode 14. Electrical connection to the uppermost electrode 14 is made through the frame 20 and a resilient braided connector 30 to facilitate expansion and contraction of the arc tube 12 and the frame 20 is maintained in position within the bulb by suitable metallic spring spacing members 32 which contact the inner surface of the dome portion of the protective envelope 18. As a discharge-sustaining filling, the arc tube contains a small controlled charge of sodium-mercury amalgam and a low pressure of inert ionizable starting gas such as 20 torrs of xenon. For some lamp types the discharge-sustaining filling can consist of sodium per se and the starting gas.

Figure 2:
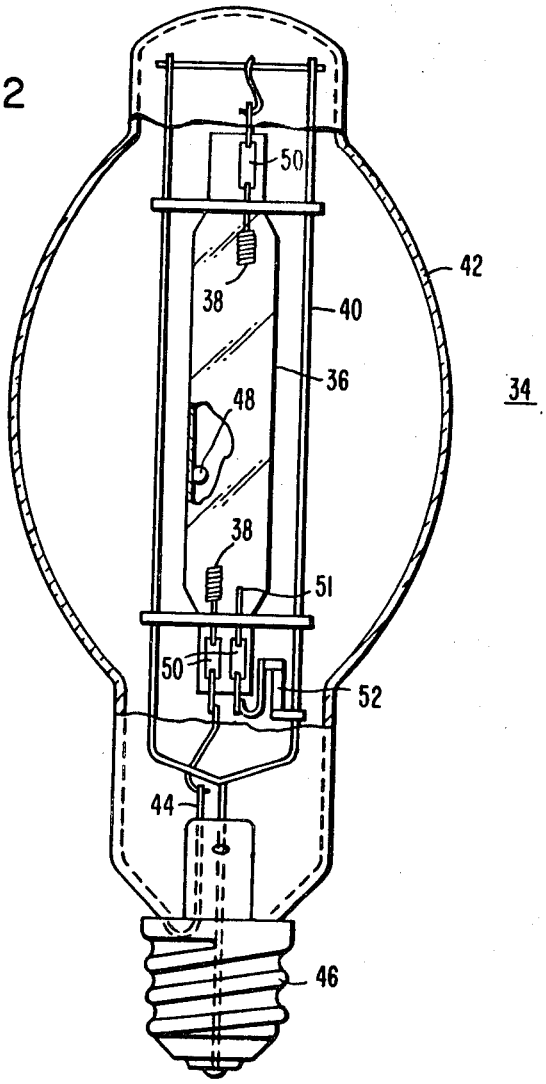
FIG. 2 is an elevational view of an HID mercury-vapor lamp which incorporates the present electrodes.

The high-pressure mercury-vapor lamp 34 as shown in FIG. 2 is also generally conventional and comprises a light transmitting arc tube 36 which is usually fabricated of quartz having the operating electrodes 38 operatively supported therein proximate the ends thereof and adapted to have an elongated arc discharge maintained therebetween. The conventional supporting frame 40 serves to suitably support the arc tube within the protective outer envelope 42 and to provide electrical connection to one of the electrodes. The other electrode is connected directly to one of the lead-in conductors 44 and thence to the base 46 so that the combination provides means for connecting the lamp electrodes 38 to an energizing power source. As is conventional, the lamp contains a small charge of mercury 48 which together with an inert ionizable starting gas comprises a discharge-sustaining filling. In this lamp embodiment, ribbon seals 50 provided at the ends of the arc tube 36 facilitate sealing the lead-in conductors therethrough in order to connect to the electrodes. A conventional starting electrode 51 connects to the frame 40 through a starting resistor 52.

Figure 3:
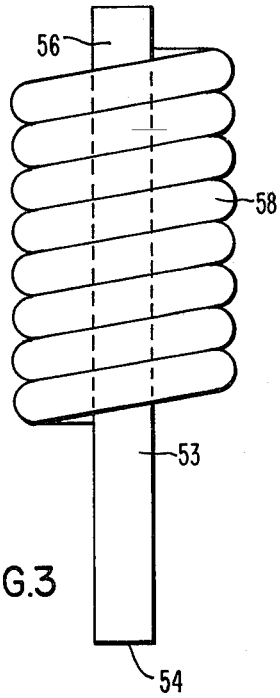
FIG. 3 is an enlarged view of the electrode tip portion showing the refractory coil carried thereon.

In FIG. 3 is shown an enlarged fragmentary view of an electrode suitable for use in an HID lamp. The electrode comprises an elongated refractory metal member 53 having one end portion thereof 54 which is adapted to be supported proximate an end of the lamp arc tube with the other end portion 56 of the metal member adapted to project a short distance inwardly within the arc tube. An overfitting refractory metal coil means 58 is carried on the elongated metal member 53 proximate the end 56 thereof. As a specific example, the elongated metal member is formed as a tungsten rod having a diameter of approximately 0.032 inch (0.8 mm) and the overfitting coil 58 as shown in FIG. 3 comprises eight turns of tungsten wire which has a diameter of 0.016 inch (0.4 mm). The outer diameter of the coil 58 can vary from 0.09 inch (2.29 mm) to 0.11 inch (2.8 mm).

Figure 4:
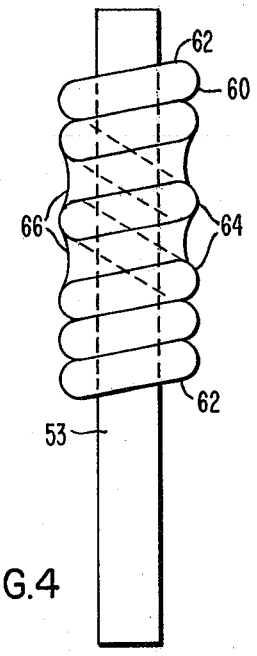
FIG. 4 is an elevational view of the tip portion of the electrode as partially fabricated showing an inner coil which has the improved electron emissive material carried intermediate spaced turns thereof.
Figure 5:
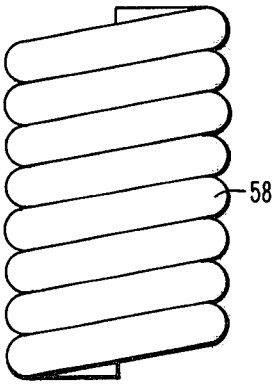
FIG. 5 is an elevational view of the overfitting coil which is screwed in place onto the inner coil as shown in FIG. 4 in order to complete the electrode.

The electrode coil in a state of assembly is shown in FIGS. 4 and 5 wherein the elongated refractory metal member 53 has a first inner coil 60 wrapped directly thereon and having such pitch between individual turns intermediate the coil ends 62 that there exists a predetermined spacing between the centrally disposed turns 64. As a specific example, the spacing between the centrally disposed individual turns 64 is approximately equal to the diameter of the wire from which the inner coil is formed. This spacing forms a protected repository for the majority of the emission material 66 which is carried by the electrode structure. An electrode construction such as the foregoing is generally known in the art as disclosed in U.S. Pat. No. 3,170,081 dated Feb. 16, 1965.

In accordance with the present invention, the electron emissive material 66 is tribarium calcium niobate or tantalate or mixtures thereof or solid solutions thereof. This emissive material can be represented by the formulation $Ba_3CaM_2O_9$ wherein M is niobium or tantalum or mixtures thereof or solid solutions thereof. These materials are very refractory with the melting temperature of tribarium calcium niobate and tribarium calcium tantalate, in vacuum, being 1850° C. and 1910° C., respectively, as compared to 1850° C. for dibarium calcium tungstate. The greatest difference in these materials as compared to dibarium calcium tungstate is found in the sensitivity with respect to reaction to water. In a controlled test, dibarium calcium tungstate, tribarium calcium niobate and tribarium calcium tantalate were packed separately in metal cavities and left exposed to air for a period of fifteen days. At the end of this period, the dibarium calcium tungstate was found to be noticeably swollen as a result of absorption of moisture ($H_20$) and carbon dioxide from the air. In comparison, neither tribarium calcium niobate nor tribarium calcium tantalate showed any sign of swelling. In another more sensitive test, measured quantities of the foregoing materials were stirred in distilled water and the pH measurement immediately taken. The dibarium calcium tungstate suspension showed a very rapid increase in the measured pH. More specifically, the pH increased from about 6.5 to 12 in about five minutes. In comparison, tribarium calcium tantalate showed no change in measured pH even after twenty-four hours of continuous stirring. The suspension of tribarium calcium niobate showed only a very slight rise in pH with prolonged stirring in distilled water.

In measured tests in HID lamps of the sodium-mercury type designed for 400 watts operation, the average initial electrode voltage drop for electrodes utilizing tribarium calcium niobate was 21.2 volts and 21.6 volts for electrodes using tribarium calcium tantalate. This is the same magnitude as the voltage drop measured for dibarium calcium tungstate or the previous mixed oxide phase emissive materials so that the electron emissive properties of these materials are all equivalent. Because of the inertness of tribarium calcium tantalates or niobates with respect to moisture, however, these materials are much simpler to handle during lamp manufacture and tendencies for electrode moisture contamination which can impair lamp performance are eliminated.

The tribarium calcium niobate or tribarium calcium tantalate emission materials can be used singly or they can be mixed in any proportions. In addition, both of these materials have the same crystalline structure and belong to the perovskite family of materials so that complete solid solutions can be formed of any relative proportions of the foregoing niobates and tantalates and used as the emission material. As a specific example for preparing the tribarium calcium niobate, there is mixed finely divided barium carbonate, calcium carbonate, and niobium oxide in such relative gram mole proportions as are desired in the final material. These raw mix constituents are placed in an alundum or alumina crucible and heated in air at a temperature of 1350° C. for approximately four hours. The final material is extremely stable and preparatory to its use, it is ground to very finely divided form, for which a representative particle size is about 11 microns. The powder material is then formed into a thick paste, using an alcohol vehicle and the paste is applied over the innermost coil 60, as shown in FIG. 4. After drying, the outer coil 58 as shown in FIG. 5 is screwed in place over the inner coil which provides a substantial degree of protection to prevent the electron emissive material 66 from being dislodged. The lamp electrodes are then mounted within the arc tube in conventional fashion and the lamp is completed. The actual amount of emission material can vary and for a typical electrode as described hereinbefore, approximately 60 to 70 mg. of emission material incorporated in each electrode for a 400 watt sodium-mercury lamp provides excellent performance. In preparing the tantalate or solid solution-niobate-tantalate versions of the emission materials, the raw mix constituents are mixed in accordance with the relative molar proportions as desired in the final fired material.

As used in sodium or sodium-mercury HID lamps, the foregoing emitters are very stable under the discharge environment and their performance in mercury vapor HID lamps is also excellent. On exposure to air or moisture conditions, the electrode materials are extremely stable.

Figure 6:
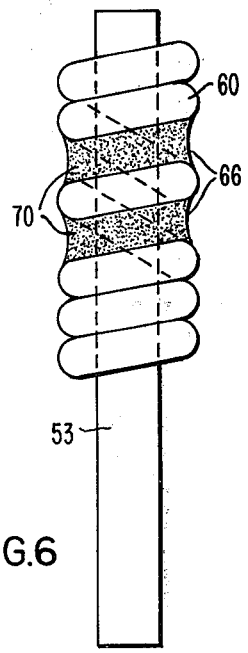
FIG. 6 is an enlarged view of an electrode tip portion generally corresponding to FIG. 3, but wherein the emission material has added thereto finely divided refractory metal particles.

In the case of mercury vapor HID lamps, it is desirable to mix with the emissive material finely divided refractory metal particles of tungsten, molybdenum, tantalum, or niobium or mixtures thereof, with the refractory metal powder comprising from 5% to 80% by weight of the emission material. The metal powder desirably is in an extremely fine state of division with a representative particle size for the powder being 0.02 to 0.6 micron. Tungsten powder is preferred, with a specific particle size being about 0.11 micron. The added metal powder acts as a refractory matrix to increase the mechanical stability of the emission material and it also minimizes sputtering of the oxide emission material when the lamp is initially started. The preferred finely divided tungsten powder preferably comprises about 15% to about 50% by weight of the emission material. Such a modified mixture is shown in FIG. 6 wherein the emission material 66 has finely divided tungsten particles 70 mixed therewith in amount of about 40% by weight of the emission material.

What is claimed is:

1. In combination with a high-intensity vapor-discharge lamp comprising a radiation-transmitting arc tube having electrodes operatively supported therein proximate the ends thereof and adapted to have an elongated arc discharge maintained therebetween, and means for connecting said electrodes to an energizing power source, the improved structure for said electrodes, each of which comprises:

a. an elongated refractory metal member having one end portion thereof supported proximate an end of said arc tube and the other end portion of said metal member projecting a short distance inwardly within said arc tube, an overfitting refractory metal coil means carried on the inwardly projecting portion of said elongated metal member; and b. electron emissive material carried intermediate turns of said overfitting coil means, said electron emissive material consists essentially of perovskite structured $Ba_3CaM_2O_9$, wherein: M is niobium, tantalum, or any combinations thereof.

2. The combination as specified in claim 1, wherein said electron emissive material is $Ba_3CaNb_2O_9$.

3. The combination as specified in claim 1, wherein said electron emission material is $Ba_3CaTa_2O_9$.

4. The combination as specified in claim 1, wherein very finely divided tungsten, molybdenum, tantalum, or niobium powder or mixtures thereof is mixed with said electron emissive material, and said powder comprises from 5% to 80% by weight of said electron emissive material.

5. The combination as specified in claim 4, wherein said finely divided powder is tungsten powder and comprises from about 15% to about 50% by weight of said emission material.

6. The combination as specified in claim 1, wherein said overfitting coil means comprises a first inner coil wrapped directly on said elongated refractory metal member and having such pitch between individual turns intermediate the coil ends that there exists a predetermined spacing between such individual turns, and a second coil overfitting said first coil and having a tight spacing between individual turns thereof, and said electron emissive material and said tungsten powder carried between said spaced individual turns of said first coil intermediate the ends thereof.

7. The combination as specified in claim 1, wherein said high-intensity discharge lamp is a high-pressure sodium or sodium-mercury vapor discharge lamp.

8. The combination as specified in claim 4, wherein said high-intensity discharge lamp is a high-intensity mercury-vapor discharge lamp.

* * * * *